US009390871B2

(12) United States Patent
Ishikawa et al.

(10) Patent No.: US 9,390,871 B2
(45) Date of Patent: Jul. 12, 2016

(54) SWITCH MECHANISM AND ELECTRONIC DEVICE

(71) Applicants: Naoyuki Ishikawa, Kanagawa (JP); Tetsuya Fujioka, Kanagawa (JP); Hideo Kanai, Tokyo (JP); Akihisa Mikawa, Kanagawa (JP); Masamichi Yamada, Kanagawa (JP); Yasunari Mikutsu, Tokyo (JP); Satoshi Tsuchiya, Kanagawa (JP)

(72) Inventors: Naoyuki Ishikawa, Kanagawa (JP); Tetsuya Fujioka, Kanagawa (JP); Hideo Kanai, Tokyo (JP); Akihisa Mikawa, Kanagawa (JP); Masamichi Yamada, Kanagawa (JP); Yasunari Mikutsu, Tokyo (JP); Satoshi Tsuchiya, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 115 days.

(21) Appl. No.: 14/306,553

(22) Filed: Jun. 17, 2014

(65) Prior Publication Data

US 2014/0374229 A1 Dec. 25, 2014

(30) Foreign Application Priority Data

Jun. 21, 2013 (JP) ..... 2013-131181

(51) Int. Cl.

| | |
|---|---|
| ***H01H 3/12*** | (2006.01) |
| ***H01H 13/14*** | (2006.01) |
| ***H01H 25/04*** | (2006.01) |

(52) U.S. Cl.
CPC ..... *H01H 25/041* (2013.01); *H01H 2025/048* (2013.01)

(58) Field of Classification Search
CPC ..... H01H 25/041; H01H 13/14
USPC ..... 200/341
See application file for complete search history.

(56) References Cited

U.S. PATENT DOCUMENTS

| | | | | |
|---|---|---|---|---|
| 8,044,314 | B2 * | 10/2011 | Weber | H01H 13/705 200/341 |
| 8,080,743 | B2 * | 12/2011 | Wang | H01H 25/041 200/5 E |
| 8,203,087 | B2 * | 6/2012 | Hu | H01H 25/041 200/6 R |
| 2010/0313409 | A1 * | 12/2010 | Weber | H01H 13/705 29/622 |
| 2011/0083952 | A1 * | 4/2011 | Hu | H01H 25/041 200/6 R |
| 2012/0262256 | A1 * | 10/2012 | Furukawa | G05G 1/02 335/106 |
| 2014/0374229 | A1 * | 12/2014 | Ishikawa | H01H 25/041 200/341 |

FOREIGN PATENT DOCUMENTS

| | | |
|---|---|---|
| JP | 2001-093386 | 4/2001 |
| JP | 2010-020344 | 1/2010 |
| JP | 2012-141641 | 7/2012 |

* cited by examiner

*Primary Examiner* — Kyung Lee
(74) *Attorney, Agent, or Firm* — Oblon, McClelland, Maier & Neustadt, L.L.P

(57) ABSTRACT

There are provided a button section; a contact-type switch that is provided in each of a plurality of directions; a button contact area that is provided on the back surface of the button section and that is brought into contact with the switch; a cover section that covers the periphery of the button section; and a flange section that is provided on the outer periphery of the button section and that is in contact with the cover section so as to restrict the button section from being ejected from inside a chassis, wherein the flange section includes cutouts at positions that are opposed to each other with the switch and the center position of the button section interposed therebetween.

6 Claims, 17 Drawing Sheets

SWITCH MECHANISM AND ELECTRONIC DEVICE

CROSS-REFERENCE TO RELATED APPLICATIONS

The present application claims priority to and incorporates by reference the entire contents of Japanese Patent Application No. 2013-131181 filed in Japan on Jun. 21, 2013.

BACKGROUND OF THE INVENTION

1. Field of the Invention

The present invention relates to a switch mechanism and an electronic device.

2. Description of the Related Art

There are conventional buttons that have button functions assigned to the left, right, top, and bottom of a single disk-shaped component in directions. There is an already-known method for, when an area near the boundary among the left, right, top, and bottom of the button is pressed, detecting the degree of operation and determining which button is to react by using the degree of operation. In Japanese Patent Application Laid-open No. 2012-141641, to prevent a wrong reaction of a button, when multiple buttons are operated, the degree of operation of each of the buttons is detected, and the operation of the button is determined by using the detected degree.

In the case of the above-described conventional button, the degree of operation of a button needs to be detected; however, the detected degree of operation does not always match the degree that is intended by a user. Specifically, when a user presses a button in a certain direction, for example, the degree of operation is detected in multiple directions in accordance with the pressed location, and an unintended wrong operation is sometimes performed.

Therefore, it is desirable to provide a button device that allows a pressing operation in multiple directions by using a single component, i.e., a button device that, when a user presses an area near the boundary between buttons, facilitates a pressing operation in the direction that is intended by the user.

SUMMARY OF THE INVENTION

It is an object of the present invention to at least partially solve the problems in the conventional technology.

According to an aspect of the present invention, there is provided a switch mechanism including: a button section; a contact-type switch that is provided in each of a plurality of directions; a button contact area that is provided on a back surface of the button section and that is brought into contact with the switch; a cover section that covers a periphery of the button section; and a flange section that is provided on an outer periphery of the button section and that is in contact with the cover section so as to restrict the button section from being ejected from inside a chassis, wherein the flange section includes cutouts at positions that are opposed to each other with the switch and a center position of the button section interposed therebetween.

According to another aspect of the present invention, there is provided an electronic device including a switch mechanism and a processing unit that performs processing in accordance with an operation of the switch mechanism, the switch mechanism including: a button section; a contact-type switch that is provided in each of a plurality of directions; a button contact area that is provided on a back surface of the button section and that is brought into contact with the switch; a cover section that covers a periphery of the button section; and a flange section that is provided on an outer periphery of the button section and that is in contact with the cover section so as to restrict the button section from being ejected from inside a chassis, wherein the flange section includes cutouts at positions that are opposed to each other with the switch and a center position of the button section interposed therebetween.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
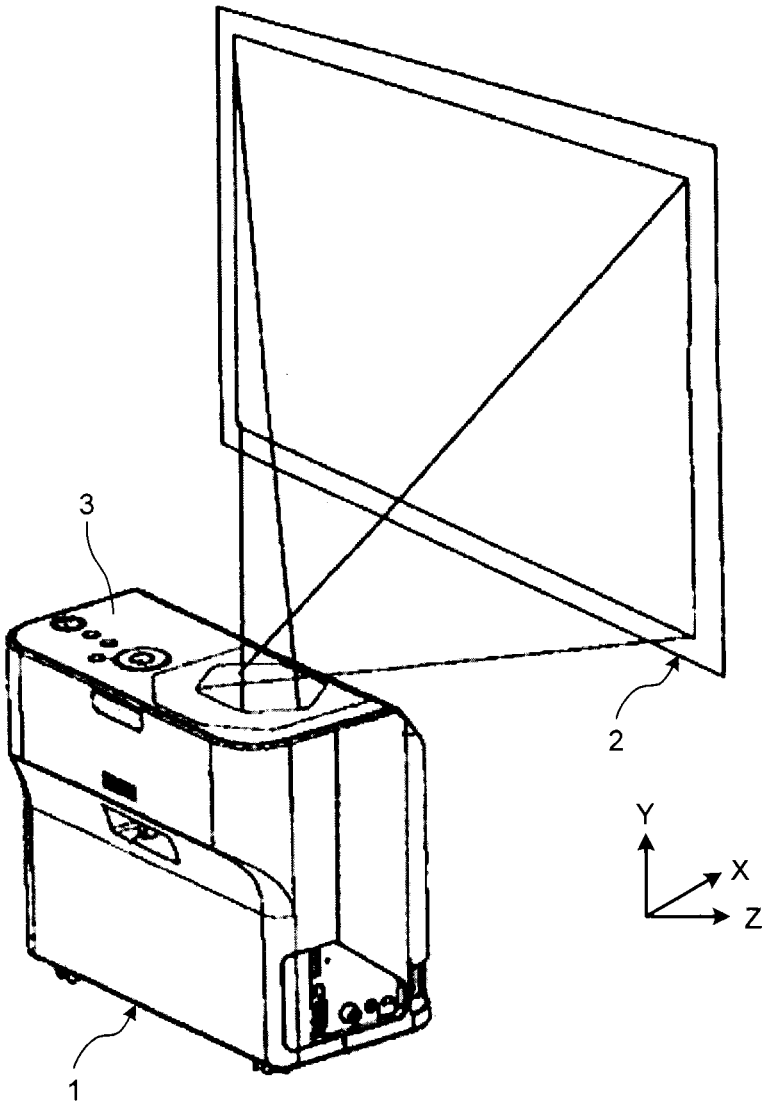
FIG. 1 is a perspective view that illustrates the mode of an image projection device according to an embodiment while in use.

An explanation is given below of an embodiment of the present invention with reference to the drawings. FIG. 1 is an external perspective view that illustrates an image projection device 1 according to the present embodiment when viewed at an angle. The image projection device 1 generates a video on the basis of video data that is input from a personal computer, video camera, or the like, and projects and displays the video on a screen 2, or the like. As for liquid-crystal projectors, which are widely known as the image projection device 1, an improvement in the brightness, a reduction in costs, and the like, have been achieved in recent years due to a higher resolution of liquid crystal panels and a higher efficiency of light source lamps. Furthermore, small and lightweight image projection devices that use a digital micromirror device (DMD) have become popular, and the image projection devices have been widely used not only in offices and schools but also at homes. Particularly, front-type projectors have an improved portability, and they are used in small conferences of a few people.

Figure 2:
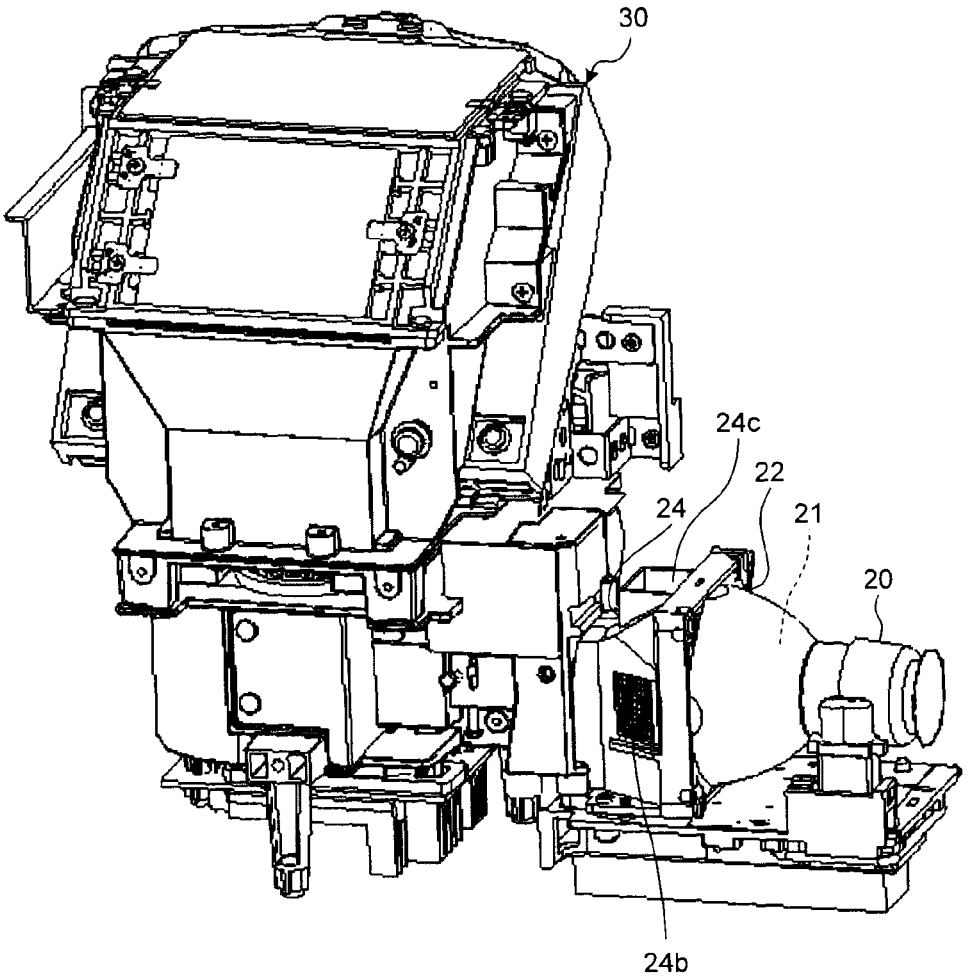
FIG. 2 is a perspective view that illustrates an optical engine unit and a light source device according to the embodiment.

FIG. 2 is a perspective view that illustrates a state where an outer layer cover 3 of the image projection device 1 of FIG. 1 is removed. As illustrated in FIG. 2, the image projection device 1 principally includes an optical engine unit 30 and a light source device 20. The light source device 20 controls a light source, such as a high-pressure mercury lamp, so as to feed light that is required to project an image, i.e., white light, to the optical engine unit 30.

The light source device 20 includes a light source bracket 22 that is a holding member that holds a light source 21, and the light source 21, such as a halogen lamp, a metal halide lamp, or a high-pressure mercury lamp, is mounted on the top of the light source bracket 22. Furthermore, a holder 24 that holds an undepicted reflector, or the like, is fastened with a screw on the output side of light from the light source 21 on the top of the light source bracket 22. An output window 23 is provided on the surface of the holder 24 on the side that is opposite to the side where the light source 21 is provided. The light output from the light source 21 is focused on the output window by the undepicted reflector that is held by the holder and is output through the output window 23. Furthermore, a light-source air supply opening 24*b* is provided on the side surface of the holder 24 to flow air so as to cool down the light source 21, and a light-source exhaust air opening 24*c* is provided on the top surface of the holder 24 to exhaust air that is heated due to the heat of the light source 21.

Figure 3:
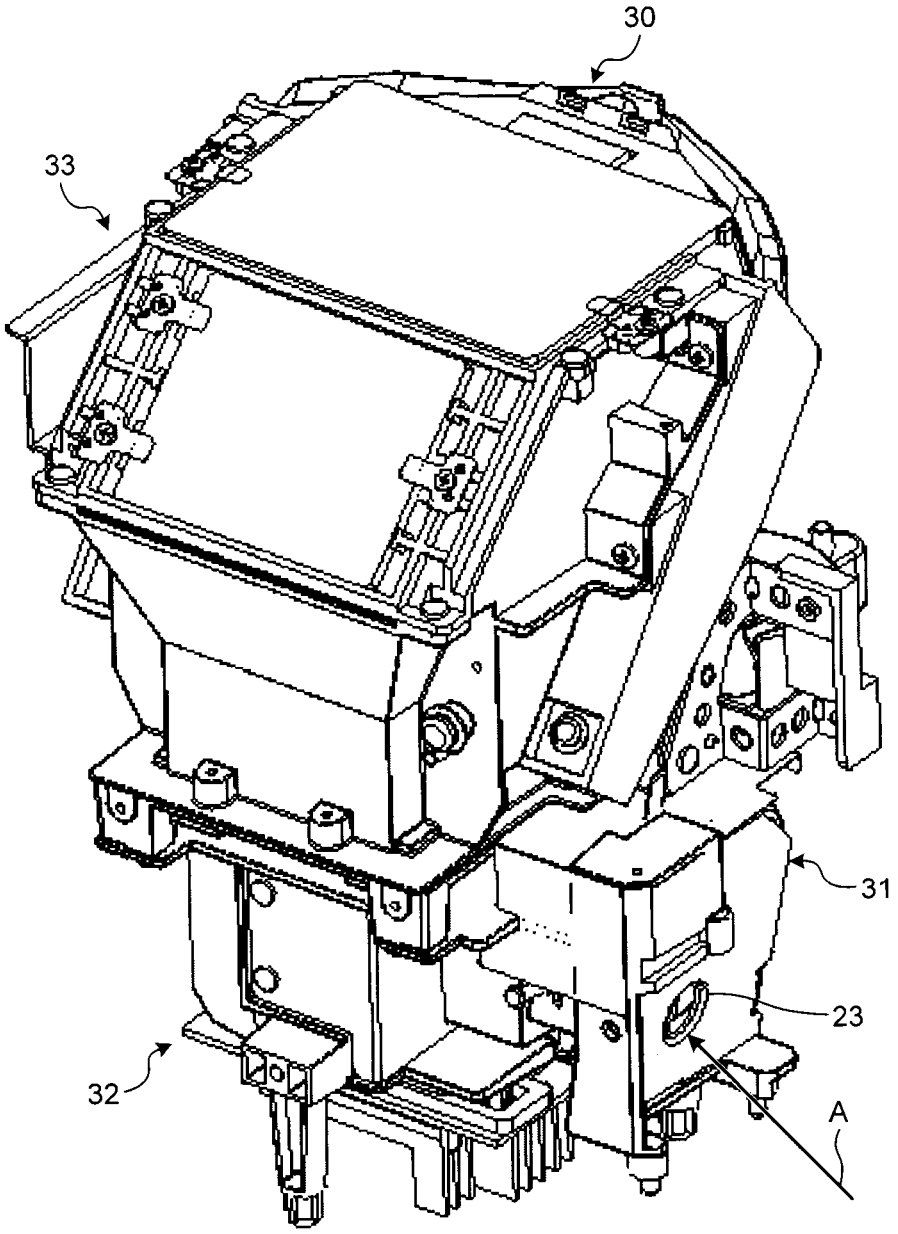
FIG. 3 is a perspective view that illustrates the optical engine unit according to the embodiment.

The optical engine unit 30 uses the light that is fed from the light source device 20, processes input image data, and controls projection. FIG. 3 is a perspective view that illustrates the detailed configuration of the optical engine unit 30. The optical engine unit 30 includes an illumination optical unit 31, a projection optical unit 33, and an image processing unit 32. The illumination optical unit 31 is first irradiated with the above-described white light from the light source device 20. The illumination optical unit 31 disperses the white light from the light source device 20 into RGB components and guides them to the image processing unit 32. The image processing unit 32 forms an image on the basis of modulated signals. The projection optical unit 33 enlarges and projects the image generated by the image processing unit 32.

Figure 4:
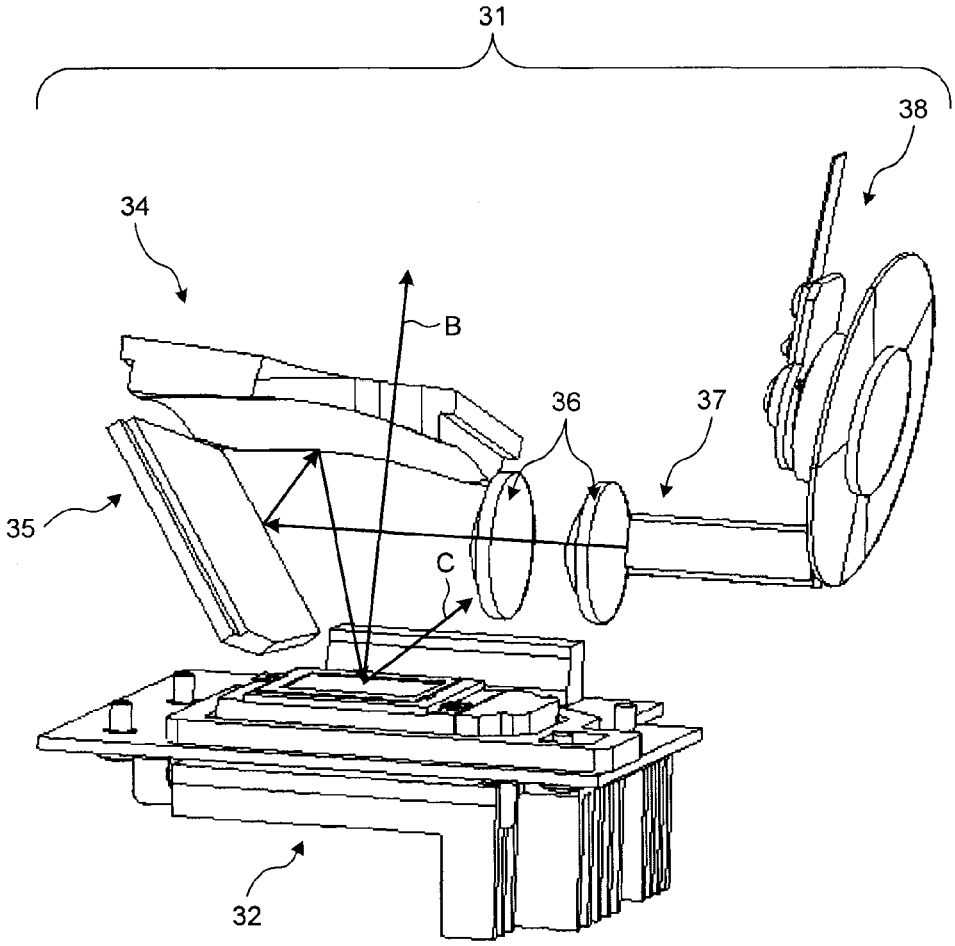
FIG. 4 is a perspective view that illustrates an illumination optical unit and an image processing unit according to the embodiment.

FIG. 4 is a layout configuration diagram of the illumination optical unit 31 and the image processing unit 32. The illumination optical unit 31 includes a color foil 38, a light tunnel 37, a relay lens 36, a cylinder mirror 35, and a concave mirror 34. The color foil 38 uses a disk-shaped color filter to convert the above-described white light output from the light source device 20 into light where each of the RGB colors is repeated per unit time, and it then outputs the light. The light tunnel 37 is formed to be tubular with plate glasses joined to each other, and it guides the light output from the color foil 38. The relay lens 36 is made up of a combination of two lenses, and it collects light while correcting the axial chromatic aberration of the light output from the light tunnel 37.

The cylinder mirror 35 and the concave mirror 34 reflect the light that is output from the relay lens 36. The reflected light enters the image processing unit 32, the image processing unit 32 includes a substantially rectangular mirror surface that includes a plurality of micromirrors, and it includes a DMD element that processes and reflects projection light to form a predetermined video while each of the micromirrors is driven in a time-multiplexed manner on the basis of video or image data. In the image processing unit 32, the light that is used by the plurality of micromirrors on the basis of the video data due to the DMD element in a time-multiplexed manner is reflected in a direction indicated by the arrow B in the drawing toward a projection lens 51, and the light to be eliminated is reflected toward an OFF optical plate as indicated by the arrow C.

Figure 5:
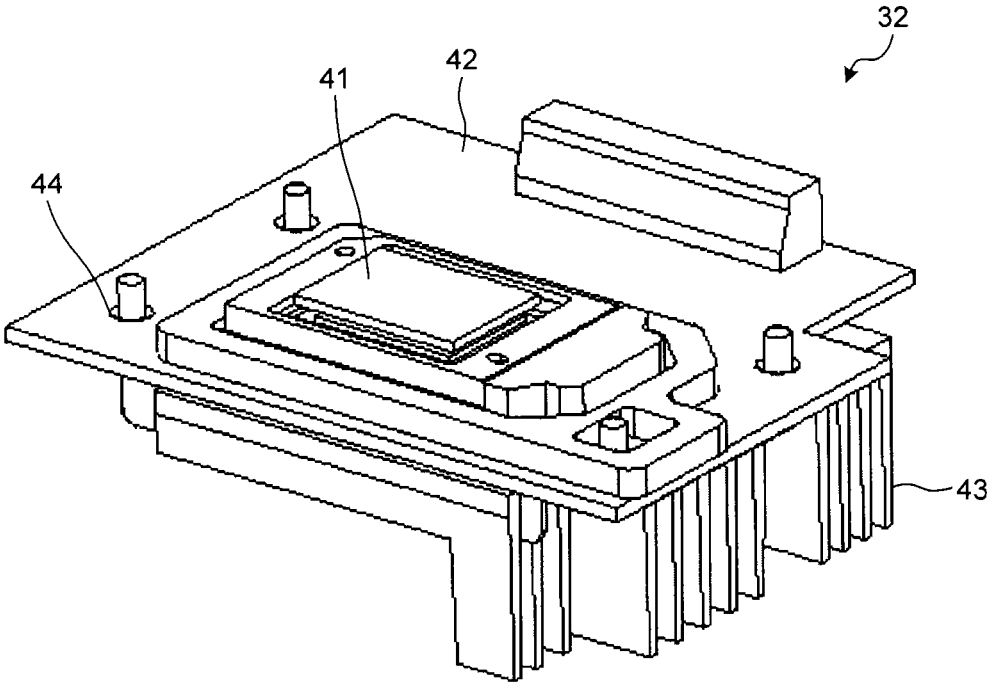
FIG. 5 is a perspective view that illustrates the image processing unit according to the embodiment.
Figure 6:
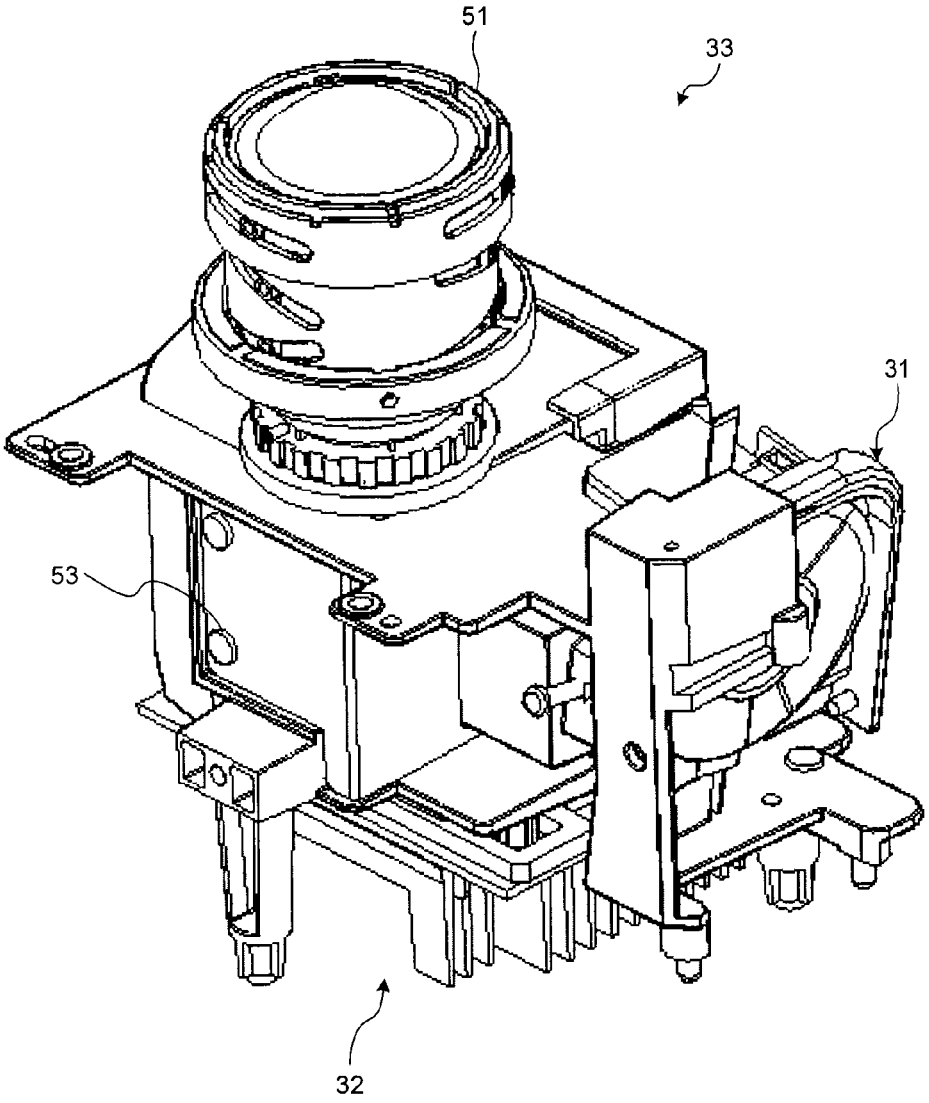
FIG. 6 is a perspective view that illustrates a projection optical unit according to the embodiment.

FIG. 5 is a perspective view that illustrates the configuration of the image processing unit 32. The image processing unit 32 includes a DMD element 41, a DMD printed board 42 that controls the DMD element 41, a heatsink 43 that cools down the DMD element 41, and a fixed plate 44 that presses the heatsink 43 against the DMD element 41. According to the present embodiment, the heatsink 43 corresponds to a heat release unit. The heatsink 43 is in contact with the DMD element 41 that is an object to be cooled down, thereby releasing the heat of the DMD element 41. Furthermore, FIG. 6 is a perspective view that illustrates the detailed configuration of the projection optical unit 33. The light transmitted through the image processing unit 32 is reflected toward the projection lens 51 of FIG. 7, and the light to be eliminated is reflected toward an OFF optical plate 53 of FIG. 7.

Figure 7:
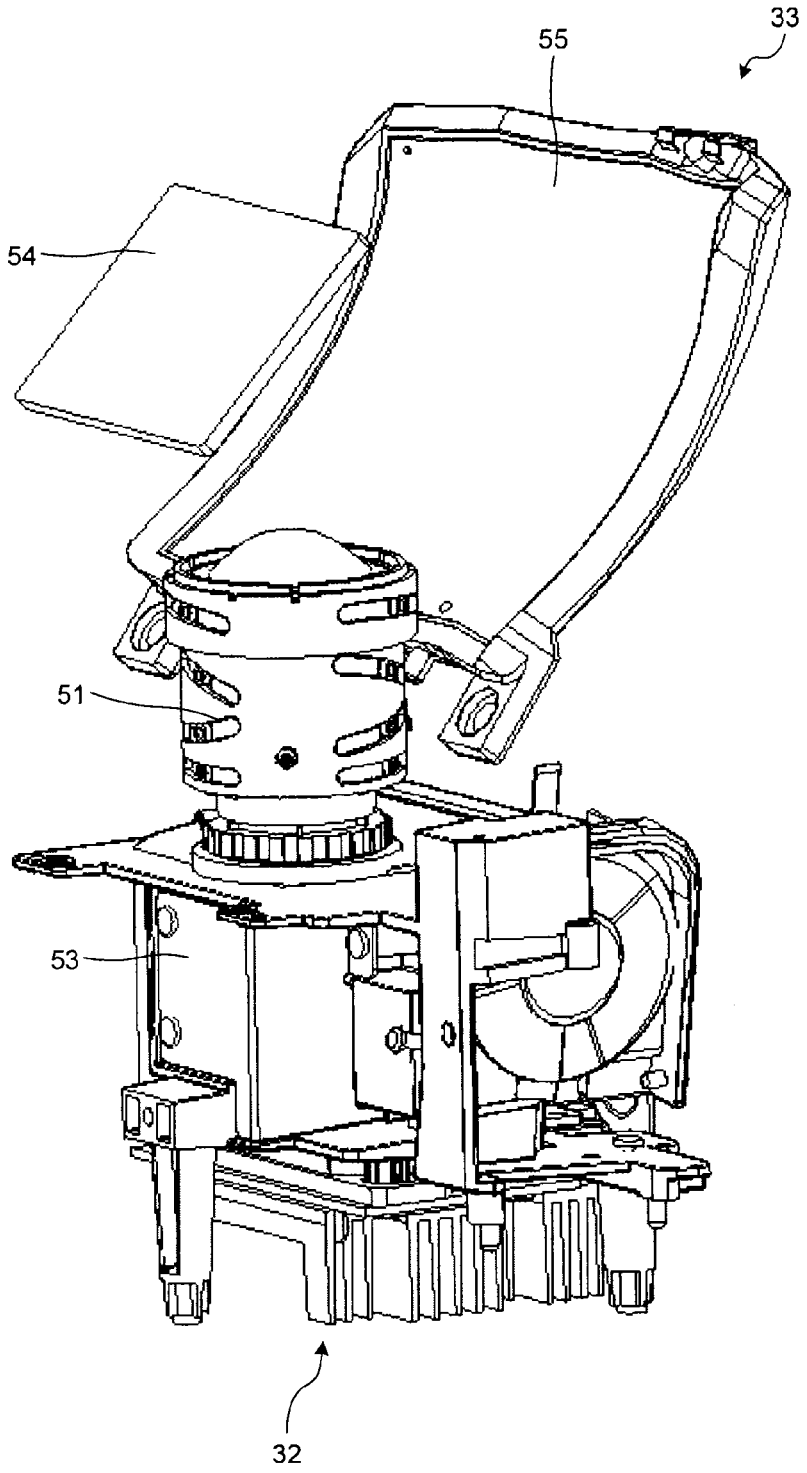
FIG. 7 is a perspective view that illustrates the projection optical unit according to the embodiment.
Figure 8:
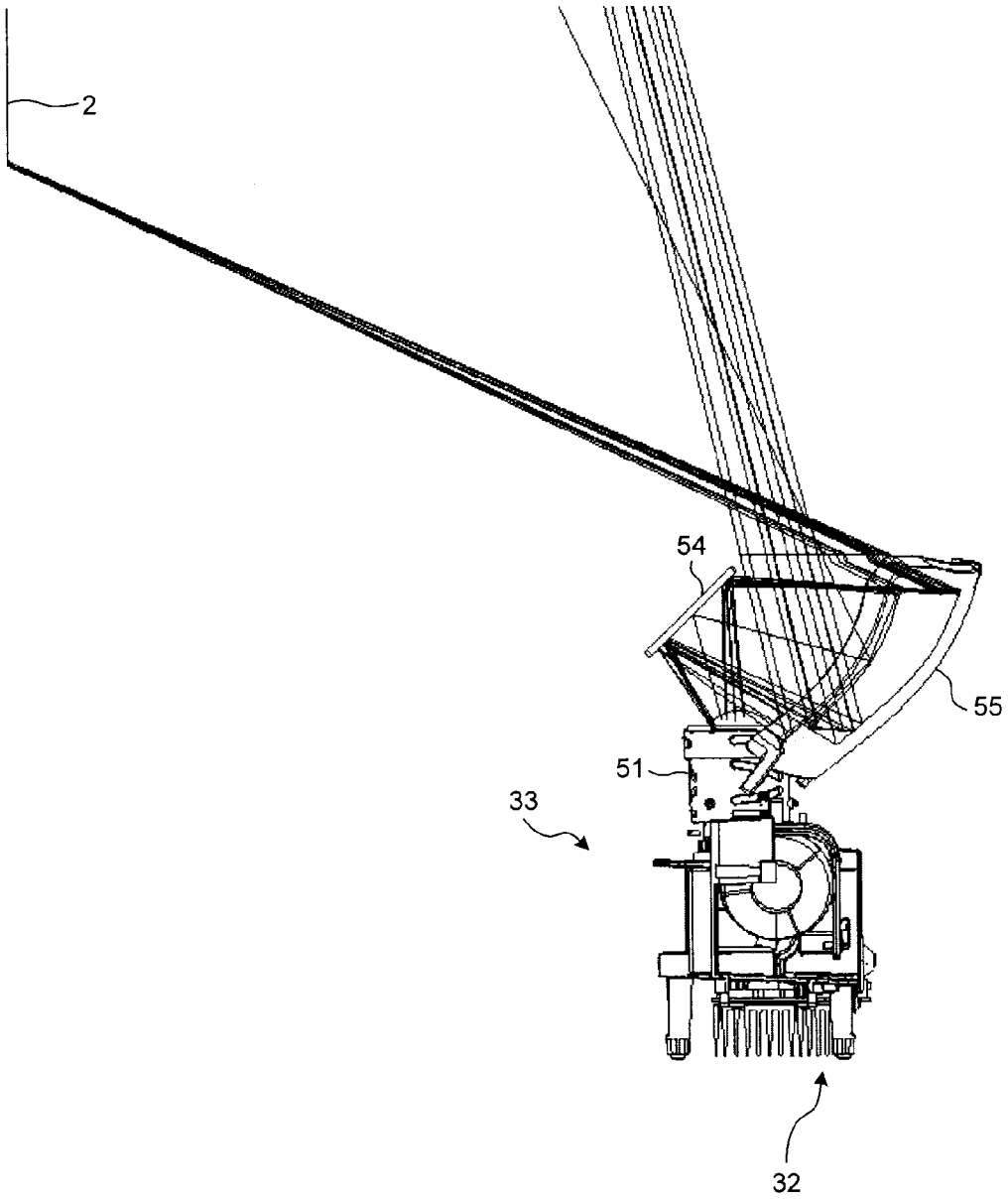
FIG. 8 is a side view that illustrates the projection optical unit according to the embodiment.

FIG. 7 is a perspective view and FIG. 8 is a side view, both illustrating the configuration of the projection optical unit 33. After video light is transmitted through the projection lens 51 so as to be increased, the optical path of the video light is returned by a return mirror 54, and the video light is increased and projected onto the screen 2 by a flexible curved mirror 55. Because of the above-described configuration, the optical engine unit 30 can be located close to the screen 2, and it can be designed to be upright, small in its installation area, cubic, and compact.

Figure 9:
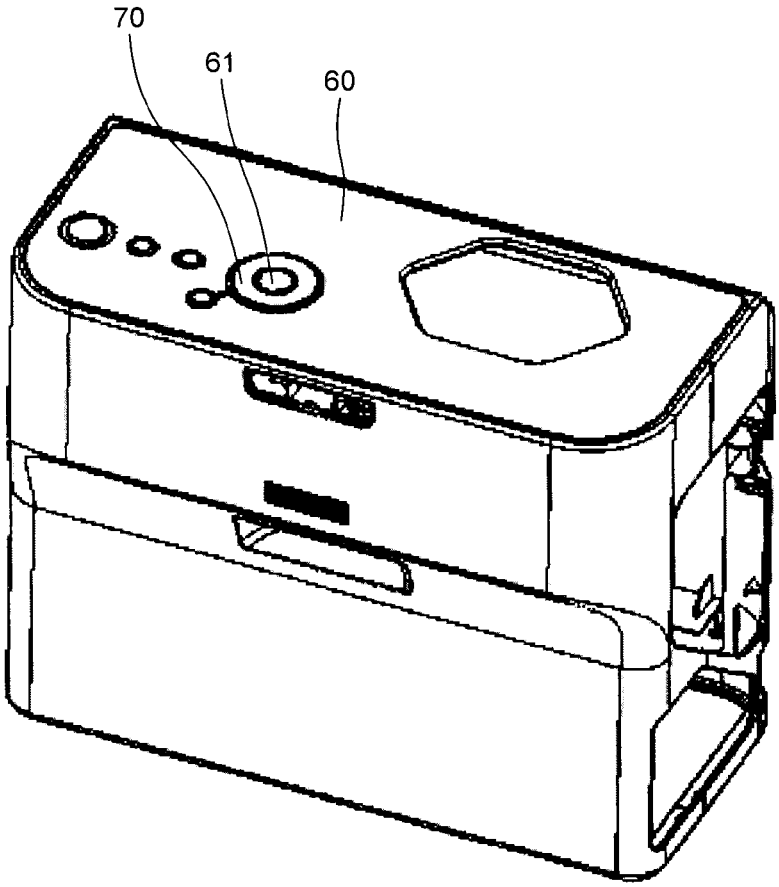
FIG. 9 is a perspective view that illustrates the image projection device according to the embodiment.

FIG. 9 is a diagram that illustrates an operating unit of the image projection device. According to the present embodiment, the operating unit is installed as a switch mechanism that has a button operated system. As illustrated in FIG. 9, a center button 61 and an operating button 70 are installed within a top-surface chassis cover 60 (cover section). The operating button 70 is a disk-shaped component, and a pressing operation can be performed on four areas on the left, right, top, and bottom of the button. According to the present embodiment, the top-surface chassis cover 60 is a member that covers the periphery of the operating button 70, and it is a member that makes up part of the chassis; however, it may be formed of a member different from the chassis, or it may be formed of the same member.

Figure 10:
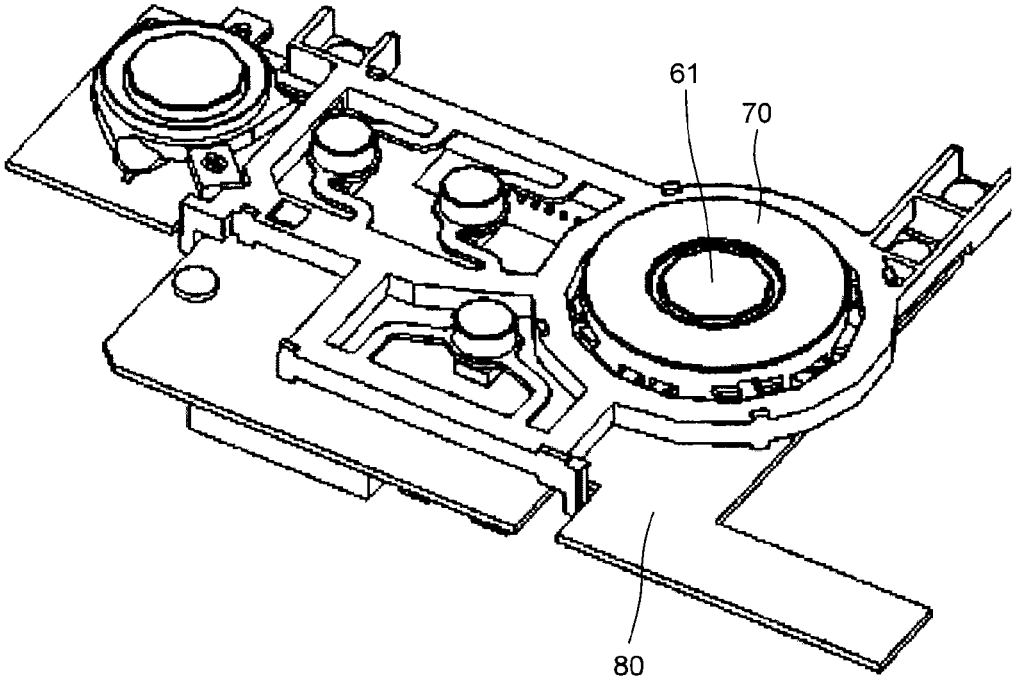
FIG. 10 is a perspective view that illustrates a switch mechanism according to the embodiment.
Figure 11:
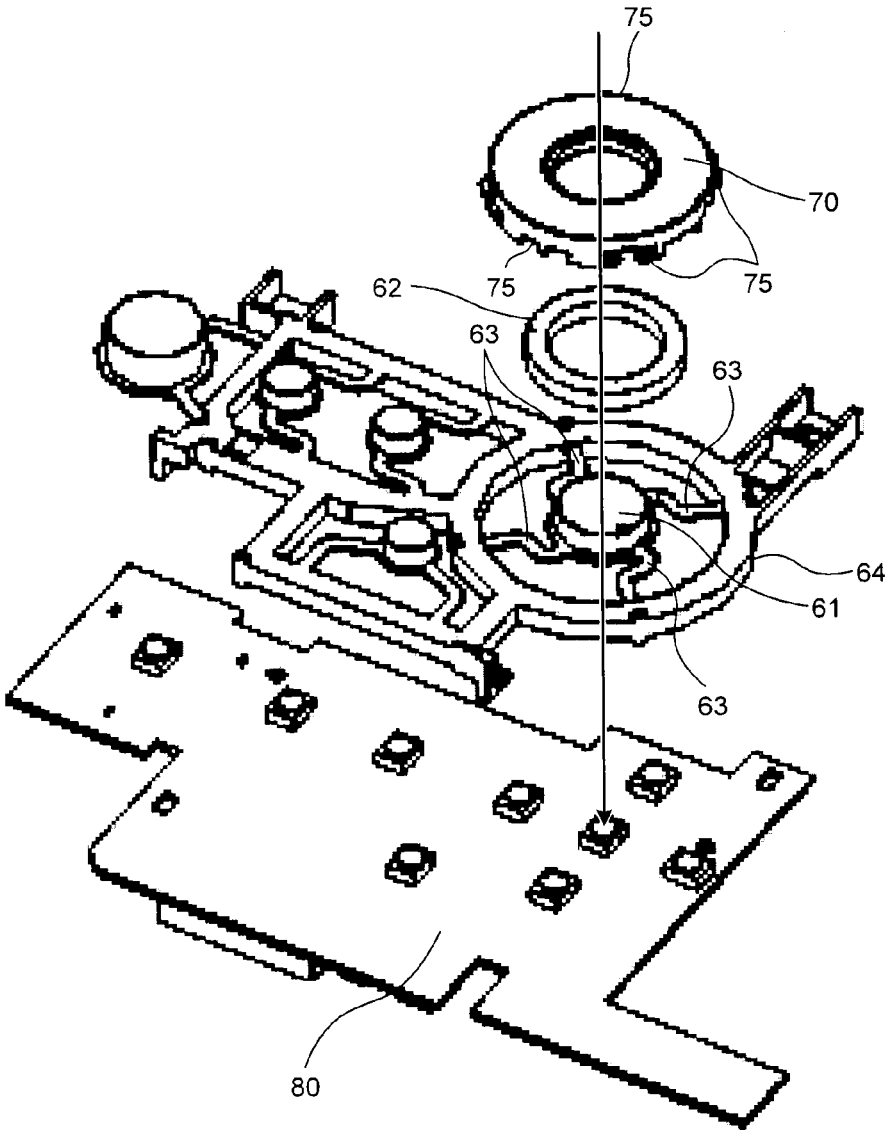
FIG. 11 is an exploded perspective view that illustrates the switch mechanism according to the embodiment.

FIG. 10 is a diagram that illustrates the center button 61, the operating button 70, and a switch board 80 that includes a switch circuit that reacts when each of the buttons 61 and 70 is pressed. Furthermore, FIG. 11 is an exploded perspective view of the center button 61 and the operating button 70. As illustrated in FIG. 11, an elastic member 62 is provided between the center button 61 and the operating button 70. The elastic member 62 is formed of a material, such as sponge, and when the operating button 70 is pressed, the elastic member 62 reacts moderately and presses the operating button 70 toward the inner side of the top-surface chassis cover 60.

Furthermore, four positioning sections 75 are provided on the outer periphery of the operating button 70. The positioning sections 75 are provided such that they have a corresponding shape and is located at a corresponding position to four supporting sections 63 that are provided on a holding unit 64 that holds each button and, when the positioning section 75 is engaged with the supporting section 63, the rotation of the operating button 70 is restricted, and the relative position with the switch is defined.

Figure 12:
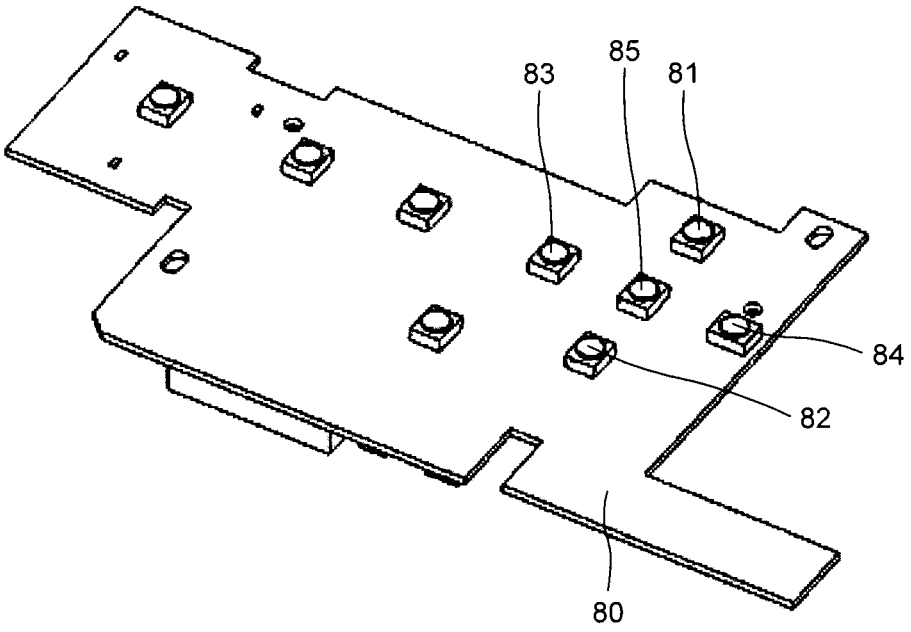
FIG. 12 is a perspective view that illustrates a switch board according to the embodiment.

FIG. 12 is a diagram that illustrates switches that are provided on the switch board 80. As illustrated in FIG. 12, a center switch 85 reacts when the center button 61 is pressed. Each of an upper switch 81, a lower switch 82, a left switch 83, and a right switch 84 reacts when any of the positions on the left, right, top, and bottom of the operating button 70 is pressed, and the switches are mounted concentrically in a plurality of directions. Specifically, each of the switches 81 to 84 is a contact-type switch that, when the operating button 70 is pressed, is brought into contact with the back surface of the button so as to operate.

Figure 13A:
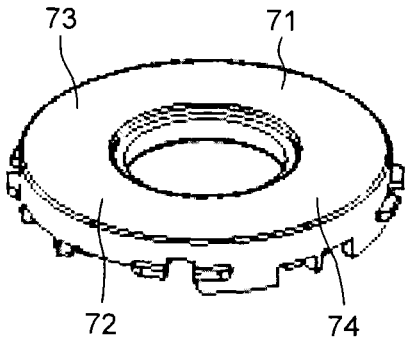
FIGS. 13A and 13B are perspective views that illustrate the front and back surfaces of a cross-shaped switch according to the embodiment.
Figure 13B:
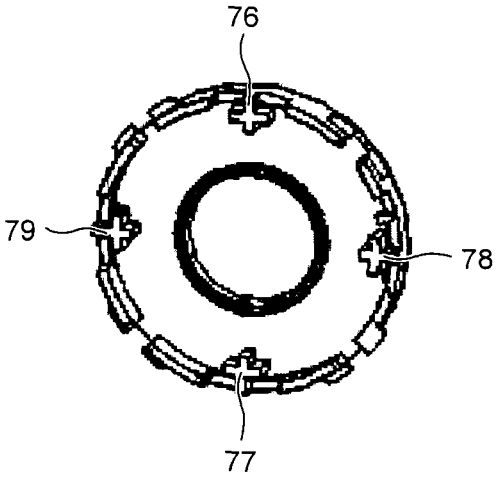

FIG. 13A illustrates the detailed configuration of the front surface of the operating button 70, and FIG. 13B illustrates the detailed configuration of the back surface of the operating button 70. As illustrated in FIGS. 13A and 13B, an upper-button back section 76 (button contact area) that corresponds to an upper button section 71 of the operating button 70 is formed into a projection and, when the upper button section 71 is pressed, the upper-button back section 76 is brought into contact with the upper switch 81, whereby the upper switch 81 reacts. In the same manner, when a lower button section 72 is pressed, a lower-button back section 77 is brought into contact with the lower switch 82, whereby the lower switch 82 reacts. When a left button section 73 is pressed, a left-button back section 78 is brought into contact with the left switch 83, whereby the left switch 83 reacts. When a right button section 74 is pressed, a right-button back section 79 is brought into contact with the right switch 84, whereby the right switch 84 reacts.

Figure 14:
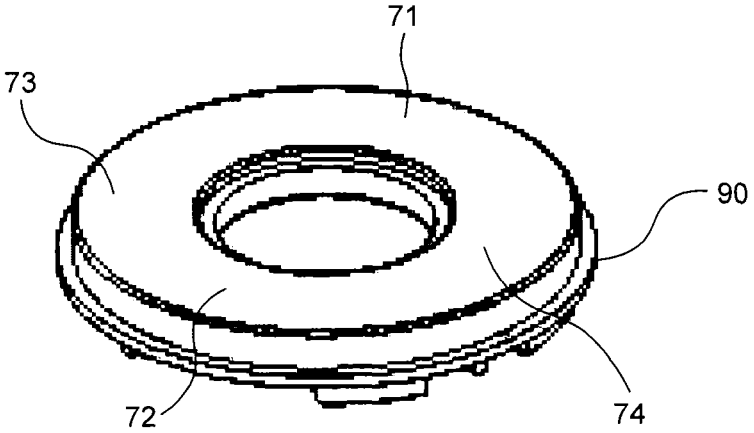
FIG. 14 is a perspective view that illustrates a conventional cross-shaped switch.
Figure 15:
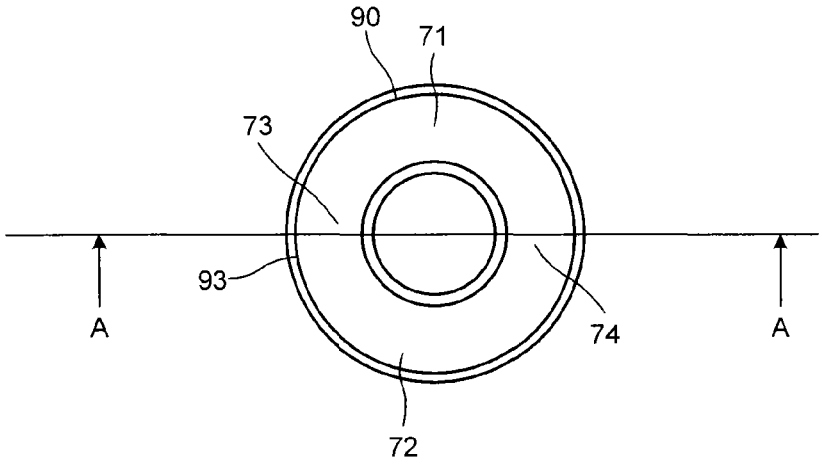
FIG. 15 is a top view that illustrates the conventional cross-shaped switch.
Figure 16:
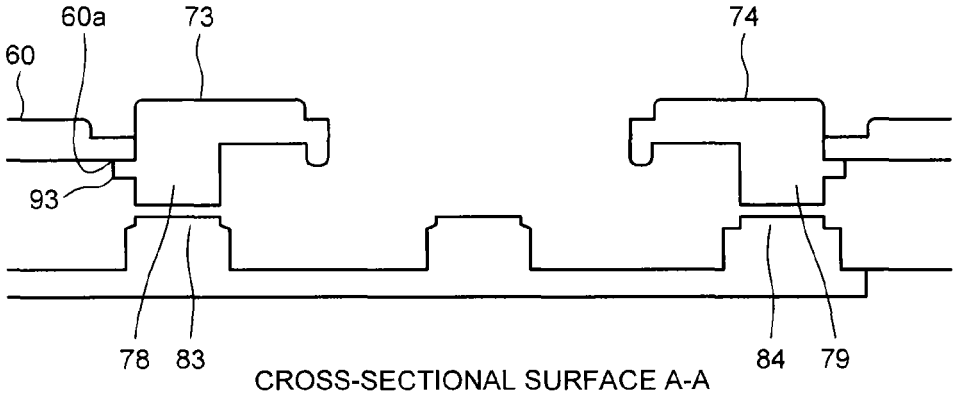
FIG. 16 is a cross-sectional view of the switch mechanism on a cross-sectional surface A-A of FIG. 15.

FIG. 14 illustrates a flange section 90 that is provided on the outer periphery of the conventional operating button 70 that is an object to be compared. When the operating button 70 is installed within the above-described top-surface chassis cover 60, the flange section 90 is engaged with the edge of a hole section that is formed on the top-surface chassis cover 60 and that is formed for the operating button 70. That is, the flange section 90 prevents the operating button 70 from being removed from the chassis through the top-surface chassis cover 60. FIG. 15 is a top view of the conventional operating button 70, and FIG. 16 is a diagram of a cross-sectional surface A-A of FIG. 15. The operating button 70 is biased toward the top-surface chassis cover 60 by the undepicted elastic member 62.

When the right button section 74 of the operating button 70 is pressed, the operating button 70 is inclined in a clockwise direction of the drawing with a contact area 60*a* between a left flange section 93 and the top-surface chassis cover 60 as a supporting point, and the right-button back section 79 is brought into contact with the right switch 84 so that the right switch operates. At this time, the position of the operating button 70 is set by the right button section 74 that is pressed by a user and the left flange section 93 that is in contact with the top-surface chassis cover 60; therefore, the operating button 70 is easily inclined in any direction, i.e., toward the upper switch 81 or the lower switch 82.

Therefore, due to the manner of pressing, there is a possibility that, at the same time the right switch 84 is brought into contact with the right-button back section 79, the upper switch 81 or the lower switch 82 is also brought into contact. Especially, if the position of the operating button 70 that is pressed by a user is farther away from the target position of the button, there is a higher possibility that multiple switches are simultaneously brought into contact, as described above. Therefore, there is a problem in that a switch that is not intended by a user reacts and a device performs an operation that is not intended by a user. Thus, the switch device according to the present embodiment uses the following configuration so as to prevent the occurrence of the above problem.

Figure 17:
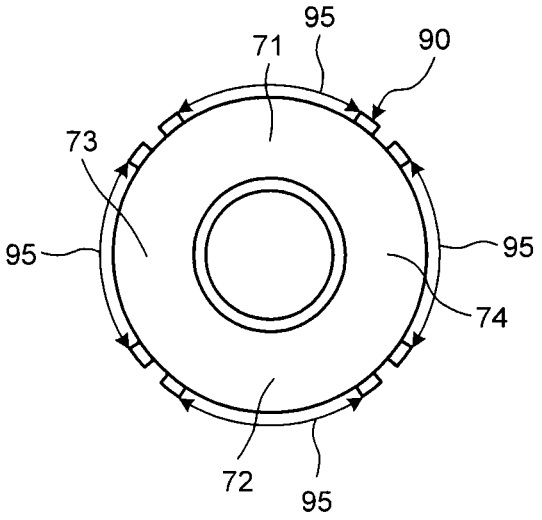
FIG. 17 is a top view that illustrates the cross-shaped switch according to the embodiment.

FIG. 17 is a diagram that illustrates a state where cutouts 95 are provided on the flange section 90 of the operating button 70 according to the present embodiment. The cutouts 95 are provided for the left, right, top, and bottom button pressing positions 71 to 74 (upper button section 71, lower button section 72, left button section 73, right button section 74), i.e., the positions that correspond to the switches, and they are provided on the positions that are opposed to each other with respect to the center of the operating button 70. The cutouts 95 has a width that is symmetric with respect to a straight line that passes through the pressing positions 71 to 74 (the center positions of the switches 81 to 84) and the center position of the operating button 70.

Figure 18:
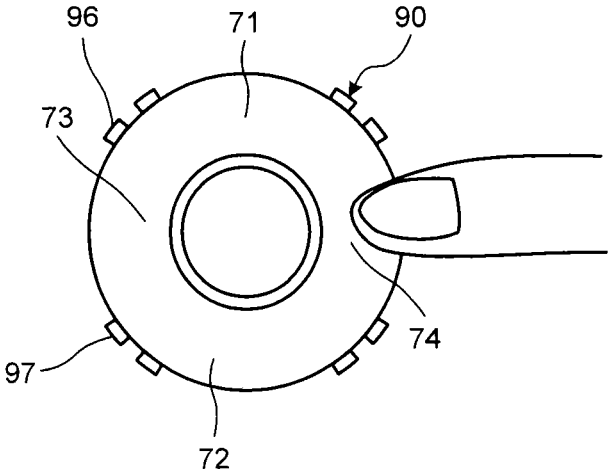
FIG. 18 is a top view that illustrates the cross-shaped switch according to the embodiment.

FIG. 18 is a diagram that illustrates a case where the cutouts 95 are provided on the flange section 90 of the operating button 70 and where the right button section 74 is pressed by a user. The operating button 70 is in contact with the top-surface chassis cover 60 at areas 96 and 97 that are included in the flange section 90 as illustrated in the drawing. Therefore, the position of the operating button 70 is set by the areas 96 and 97 and the right button section 74 that is in contact with the user's finger; thus, the position is stable. Specifically, the two points, i.e., the areas 96 and 97, of the flange section 90 are brought into contact with the top-surface chassis cover 60; therefore, a state is obtained such that the inclination in a vertical direction when viewed from the right button section 74 is restricted.

Figure 19:
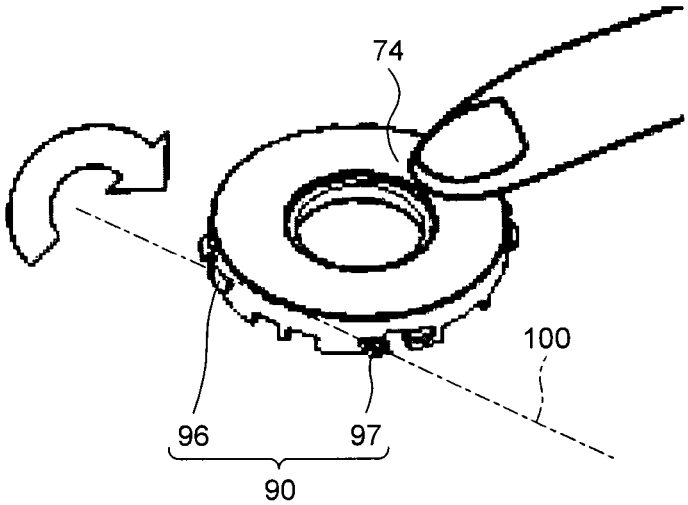
FIG. 19 is a perspective view that illustrates a state where the cross-shaped switch according to the embodiment is pressed.

At this time, as illustrated in FIG. 19, even if the position pressed by the user's finger is shifted from the position of the right button section 74 toward any one of the upper and lower switches by a certain degree, the button moves around a rotation axis 100 that connects the area 96 and the area 97; therefore, it is possible to prevent a cross-shaped button from being inclined toward any one of the upper and lower switches and to prevent a switch that is not intended by a user from reacting.

In the case described above according to the embodiment, the cross-shaped button is circular; however, the shape of the button is not limited to this, and it may have a different shape, such as a quadrilateral. Furthermore, the number of switches or the number of cutouts that correspond to the switches is not limited to those in the embodiment.

The above-described switch mechanism may be provided in not only the image projection device but also an electronic device, or the like, that includes a processor, an arithmetic circuit, or a processing unit, such as an arithmetic device, that performs a specific operation when the switch mechanism is operated.

According to the present embodiment, in a button device that uses a single component on which a pressing operation can be performed in multiple directions, the button device produces an advantage such that, when a user presses an area near the boundary between buttons, the button device facilitates a pressing operation in the direction that is intended by the user.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A switch mechanism comprising:

a button section;

a contact-type switch that is provided in each of a plurality of directions;

a button contact area that extends from a back surface of the button section and that is configured to be brought into contact with the switch;

a cover section that covers a periphery of the button section; and a flange section that is provided on an outer periphery of the button section and that is in contact with the cover section so as to restrict the button section from being ejected from inside a chassis, wherein the flange section includes cutouts at positions that are opposed to each other with the switch and a center position of the button section interposed therebetween, and the cutout has a width that is symmetric with respect to a straight line that connects a center position of the button contact area and the center position of the button section.

2. The switch mechanism according to claim 1, wherein the switch is arranged concentrically with respect to a center of the button section.

3. The switch mechanism according to claim 1, further comprising an elastic member that presses the flange section toward an inner side of the cover section.

4. The switch mechanism according to claim 1, further comprising a positioning section that is provided on the outer periphery of the button section and that defines a relative position with the switch.

5. The switch mechanism according to claim 1, wherein the button section includes a number of contact areas and a same number of cutouts that each has a width that is symmetric with respect to a straight line that connects a respective center position of each button contact area and the center position of the button section.

6. An electronic device comprising a switch mechanism and a processing unit that performs processing in accordance with an operation of the switch mechanism, the switch mechanism comprising:

a button section;

a contact-type switch that is provided in each of a plurality of directions;

a button contact area that extends from a back surface of the button section and that is configured to be brought into contact with the switch;

a cover section that covers a periphery of the button section; and a flange section that is provided on an outer periphery of the button section and that is in contact with the cover section so as to restrict the button section from being ejected from inside a chassis, wherein the flange section includes cutouts at positions that are opposed to each other with the switch and a center position of the button section interposed therebetween, and the cutout has a width that is symmetric with respect to a straight line that connects a center position of the button contact area and the center position of the button section.

* * * * *